United States Patent [19]

Story et al.

[11] 4,397,760

[45] Aug. 9, 1983

[54] RAPID SAPONIFICATION PROCESS

[75] Inventors: Julian R. Story, Fountain Hills; E. Gary Myers, Scottsdale, both of Ariz.

[73] Assignee: Armour-Dial, Inc., Phoenix, Ariz.

[21] Appl. No.: 291,525

[22] Filed: Aug. 10, 1981

[51] Int. Cl.[3] ..... C11D 13/10

[52] U.S. Cl. ..... 252/370; 252/108; 252/369; 260/415; 260/416; 260/417; 260/418; 366/224; 366/222; 366/105; 366/12; 366/13; 366/298

[58] Field of Search ..... 252/369, 370, 108; 260/415, 416, 417, 418; 366/224, 222, 105, 12, 13, 298

[56] References Cited

U.S. PATENT DOCUMENTS

| | | | |
|---|---|---|---|
| 1,722,687 | 7/1929 | Spensley | 252/369 |
| 2,730,539 | 1/1956 | Bradford | 260/417 |
| 2,753,363 | 7/1956 | Winer | 260/413 |
| 3,657,146 | 4/1972 | Fransen et al. | 252/369 |
| 3,674,241 | 7/1972 | Eirich et al. | 366/105 |
| 4,294,771 | 10/1981 | Pietralla et al. | 260/413 |

*Primary Examiner*—John E. Kittle
*Assistant Examiner*—Robert A. Wax
*Attorney, Agent, or Firm*—Frank T. Barber; Richard G. Harrer

[57] ABSTRACT

A process for the preparation of soap and soap/synthetic detergent products from raw materials normally employed in the manufacture of such products including fatty acids, triglycerides and caustic by subjecting such raw materials to intensive countercurrent mixing whereby saponification takes place in a relatively short time to yield a product, preferably in granular form, which requires no further drying for most uses. The resulting product can, if desired, be then subjected to plodding, extrusion and stamping to form soap in bar form.

18 Claims, 12 Drawing Figures

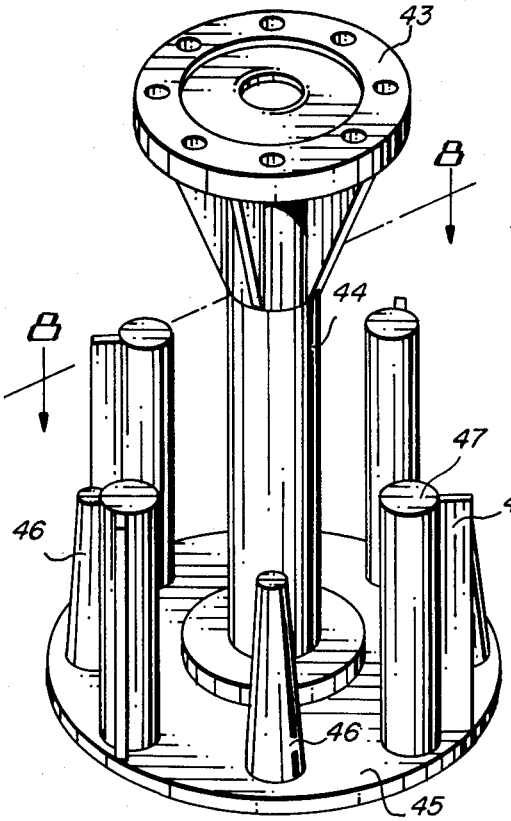
FIG. 7
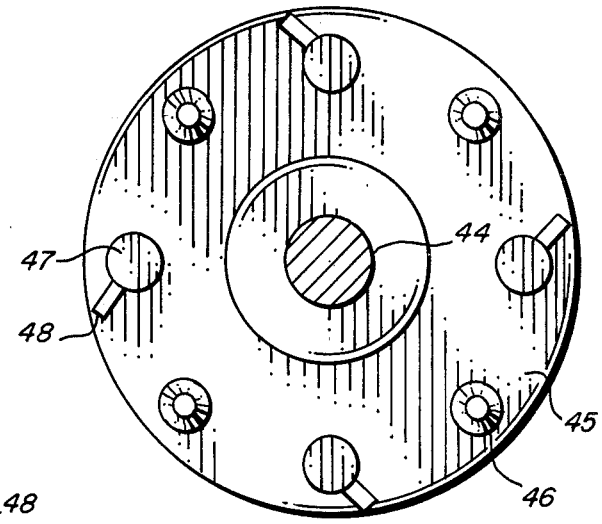
FIG. 8
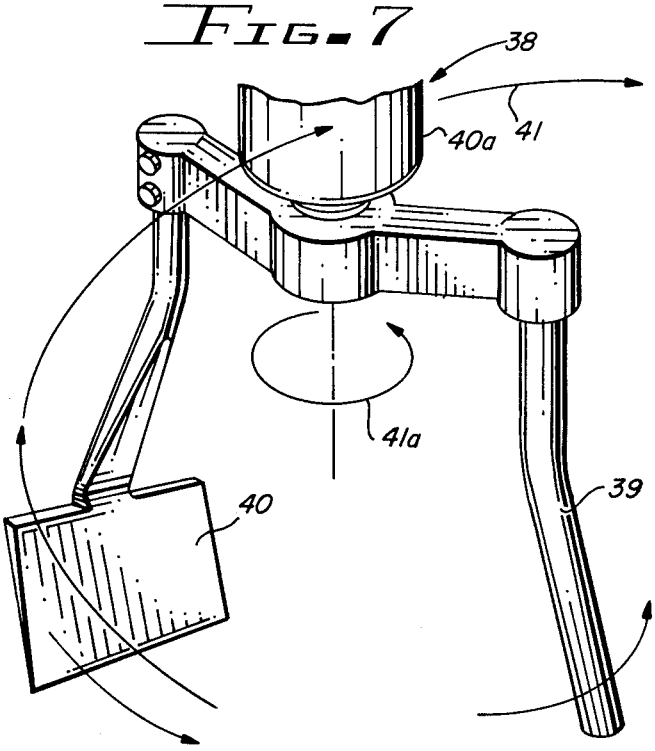
FIG. 9
FIG. 10
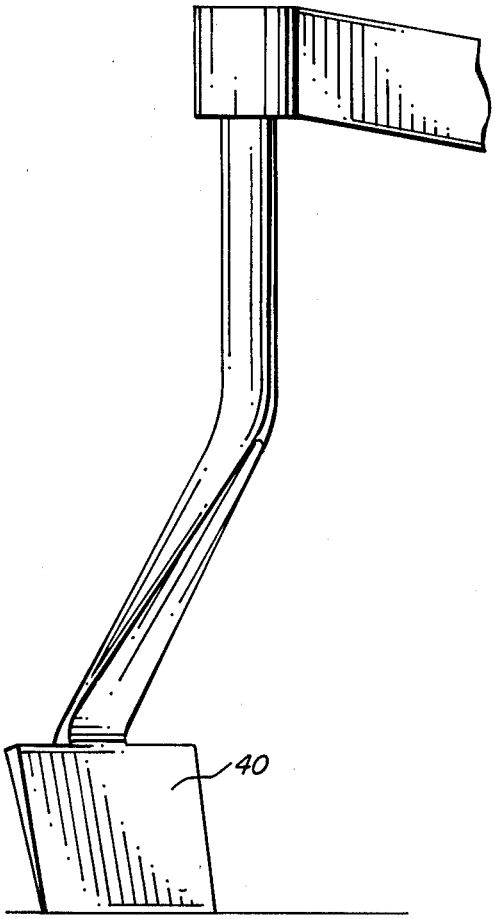

RAPID SAPONIFICATION PROCESS

This invention relates to energy saving, rapid processes for the preparation of soap and soap/synthetic detergent products. More particularly, the invention relates to the use of countercurrent mixing to produce soap, usually in granular form, from the raw materials normally employed in making soap.

BACKGROUND

Although soap can be made by a number of different techniques, today its commercial manufacture basically involves either some type of batch (kettle) saponification or a continuous process which includes the splitting of fats into fatty acids and glycerine and then the neutralization of such fatty acids with caustic (usually either sodium hydroxide or potassium hydroxide) containing the proper amount of water to yield a neat soap containing about 30 percent by weight of moisture. While the most modern way to make soap is neutralizing fatty acids, considerable soap is still made by batch techniques which involve "cold process saponification", "semi-boiled saponification" and a so-called "kettle process". The cold process saponification is the simpliest of the batch procedures and since neither lyes nor nigre are separated, the glycerol and impurities from the fats remain in the soap. The charge of fat is simply melted in a vessel equipped with a mechanical stirrer and the calculated amounts of caustic soda solution is added with vigorous stirring. The fats and oils are mixed for a short time, usually from about ten minutes to one hour, or before the mix becomes too viscous to pour. At this time the saponification is about 90% complete. The mix is then poured into a frame and stored about two days to a week until hard. During this aging period, the saponification is completed. The semi-boiled saponification technique is similar to the cold process, although a higher temperature is used to speed saponification and permit adjustment of the alkali content before framing. The fat charge and alkali (which may be caustic potash when soft soaps are desired) are thoroughly mixed at 160°–175° F. until the soap becomes smooth. No glycerine is recovered in this process. The kettle process usually involves recovery of the glycerine. In this process fat and a relatively weak solution of sodium hydroxide are pumped into the kettle simultaneously. As soon as the dilute caustic mixes with the fat, saponification starts. The liquid mass is boiled by the admission of steam at the bottom of the kettle and as saponification proceeds, stronger caustic is added gradually until the saponification is almost complete. The soap is then "salted out" or "grained out" by the addition of a large amount of salt; the sodium soap, bein insoluble in the concentrated salt solution and of a lower density rises to the top of the kettle and the salt solution containing salt, glycerine, impurities and excess alkali collect at the bottom of the vessel. The bottom brine layer is drawn off and then water and an excess of lye are added to the soap remaining in the kettle. The mixture is boiled with steam to saponify the last traces of fat. The solution which collects at the bottom of the kettle during the subsequent settling process is drawn off. Brine is then added to the soap; the mass is boiled and allowed to stand until brine washed soap rises to the top of the kettle. The brine washing is repeated several times with fresh brine until the excess alkali and glycerine in soap are reduced to a minimum. The neat soap is then sent to dryers such as a Proctor-Swartz.

No matter what soap making procedure is employed, the end product is neat soap which is usually subjected to further processing. For example, when neat soap is to be further processed to form bars or flakes, the water content of the neat soap must be reduced to the range of about 10–20 percent by weight. This drying can be accomplished in a number of ways. In one procedure the neat soap flows onto a so-called chill roll which spreads the fluid soap into a thin film which then solidifies. The solidified soap film is removed in ribbon form and then oven dried to the required moisture content. More modern techniques utilize vacuum spray dryers to reduce the moisture content to a proper level. Following drying, the soap is passed to an amalgamator where perfume, color and other soap addivites are mixed into the soap mass and from there the soap can be milled and plodded. The final steps to bar soap manufacture include the extrusion of the plodded soap through a tapered outlet to form a continuous log followed by cutting, stamping and finally packaging. It will be appreciated that in conventional soap bar/soap flake manufacturing practices, the drying and plodding steps are energy-intensive and very time consuming and it would be extremely desirable to develop a soap-making process which would either substantially reduce or eliminate the drying operation which is currently required to produce most soap products.

Various proposals have been advanced to solve the problem of producing low moisture soap by eliminating or substantially reducing the energy required for drying but so far as we know none have really proved to be commercially feasible. For example, U.S. Pat. No. 2,730,539 discloses a method of saponifying fat such as tallow or vegetable oils with caustic to form a low moisture content soap using a "muller" type mixer. The soap making ingredient, such as tallow, and a solution of caustic soda are introduced into the muller mixer and subjected to a shearing and smearing action by the mulling action of the heavy wheels rolling over the materials in the pan. According to the patent, a high order of mechanical pressure is applied to the soap-forming ingredients which results in a soap which is said to be suitable for plodding and then stamping into bars.

Also, U.S. Pat. No. 3,657,146 discloses a process for the direct production of soap from fatty acids and caustic in a pressure vessel at about 2 to 10 atmospheres and at a temperature ranging from 120° to 180° C. The process is said to produce a soap having not more than about 25 percent water content and in this connection example 2 of said patent shows a soap which contains 9 percent of free fatty acids and 145 percent of water.

In addition, the use of a two-stage saponification procedure is disclosed in U.S. Pat. No. 2,753,363. The initial reaction takes place between the fatty acids and a dry, alkali metal carbonate such as sodium carbonate to achieve a partial saponification. Following this the partially saponified mass is treated with aqueous alkali metal hydroxide to complete the reaction.

U.S. Pat. No. 1,722,687 discloses the use of a high speed centrifugal pinned disc mill to make framed soaps, soft soaps and dry soap powders. In the process the soap making ingredients are introduced into the mill and the lower rotating disc is run at very high speed causing a beating action of the reactants by the lower rotating pins and upper stationary pins.

OBJECTS OF THE INVENTION

It is an object of the present invention to provide a process for the production of low moisture water soluble soaps from raw materials normally employed in soap manufacture including triglycerides, fatty acids and caustic and or alkalis such as triethanolamine which substantially reduces or eliminates entirely the need to dry the soap prior to forming it into bars and the like.

A further object is to provide a rapid process for making low moisture soap under ambient pressure and temperature conditions where stoichiometric amounts of triglycerides or fatty acid and caustic can be processed to produce non-tacky soap in granular form having a typical moisture content of about 20 percent or less.

Another object is to provide a rapid process for the production of low moisture soap in the form of granules which eliminates the need to process the soap through an amalgamator and one of the plodding steps.

A still further object is to provide a process for the production of a soap/synthetic detergent product which eliminates the need to dry the product prior to forming it into bars and the like.

Other objects of this invention will become apparent as the specification proceeds.

SUMMARY OF THE INVENTION

We have discovered that high-quality soap can be produced by combining an appropriate source of long chain monocarboxylic acids such as triglycerides or fatty acids and caustic in a mixing chamber so that the triglycerides and/or fatty acids and caustic are subjected to an intensive countercurrent mixing whereby the triglycerides and/or fatty acids and caustic are saponified in a short period of time to yield a low moisture soap, preferably in granule form, which requires no further drying for most uses. As used herein the expression "fatty acid source" means the raw materials which are customarily employed in soap manufacture such as the naturally occurring fats and oils which are triglycerides with three fatty groups randomly esterified with glycerol (tallow, lard, coconut oil, palm kernal oils and the like) or the fatty acids which result from the "splitting" or hydrolysis of the triglyceride fats and oils or the fatty acids derived from synthetic sources. The expression "saponify" or "saponification" means either the neutralization of fatty acids to produce soap or the saponification of fats and/or oils to produce soap. By intensive countercurrent mixing we mean causing a liquid stream of the reactants to rapidly move in a circular direction (e.g. clockwise) within a mixing vessel and at the same time bringing this rapidly moving stream into contact with mixing means rotating rapidly in a direction counter (e.g. counterclockwise) to the flow of the reactant stream. This head on meeting of the rapidly, circular moving stream with the counter rotating mixing means creates a generally rotary movement of the reactants within the vessel appearing much like an eddy stream or whirlpool. The reaction time can be shortened by mounting the counter-rotating means eccentrically within the vessel and at a distance from the wall of the vessel. When the counter-rotating means are so mounted it is desirable to provide deflecting means within the vessel which serve to direct the stream of reactants to the counter-rotating means. The reactants are thereby directed into several counter moving paths and brought together again at high impact velocity.

GENERAL DESCRIPTION OF THE DRAWINGS

FIG. 7 and FIG. 12 are perspective views of rotors useful in the mixing equipment shown in FIG. 11.

FIG. 8 is a sectional view taken substantially on the line 8—8 of FIG. 7.

FIG. 9 is a perspective view of a mixing tool which is mounted within the mixing equipment shown in FIG. 11.

FIG. 10 is an enlarged view of the mixing plow shown in FIG. 9.

Figure 1:
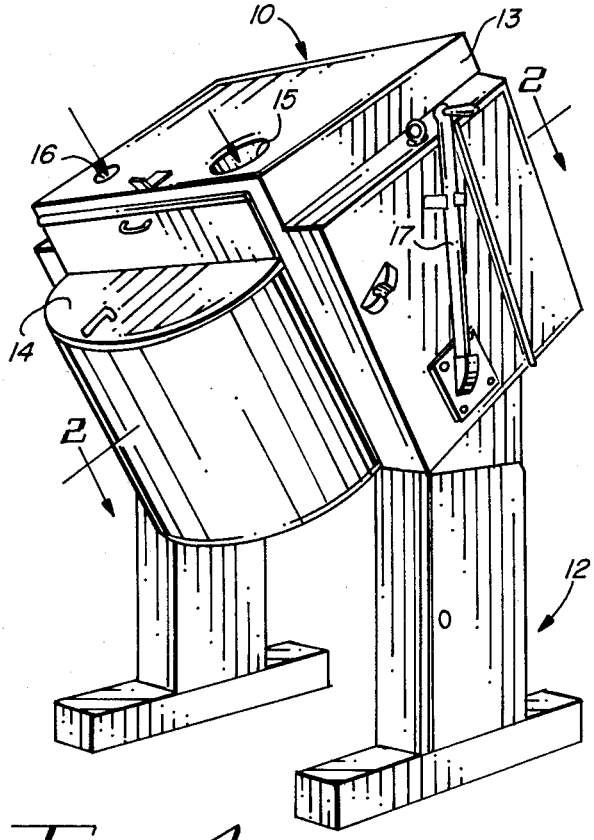
FIG. 1 is a perspective view of mixing equipment adapted to provide the intensive countercurrent mixing of the fatty acid sources and caustic.

Referring to the drawings, FIG. 1 shows an embodiment of the mixing equipment useful in our invention and is designated generally at 10. The mixer 10 can be described as a mixing pan 11 rotatably mounted on frame 12 and surrounded by metal shroud 13. Access to the interior of the mixer and more specifically to the mixing pan is provided by hinged loading door 14. At the top of the shroud 13 are ports 15 and 16 which can be used to introduce materials and/or air directly to the mixing pan or to serve as an exit for gases which may develop during the saponification process. The equipment is further provided with a water tight discharge gate 29 at the bottom of the mixing pan and this discharge gate is controlled by handle 17. The discharge gate allows for removal of the soap after saponification has been completed.

Figure 2:
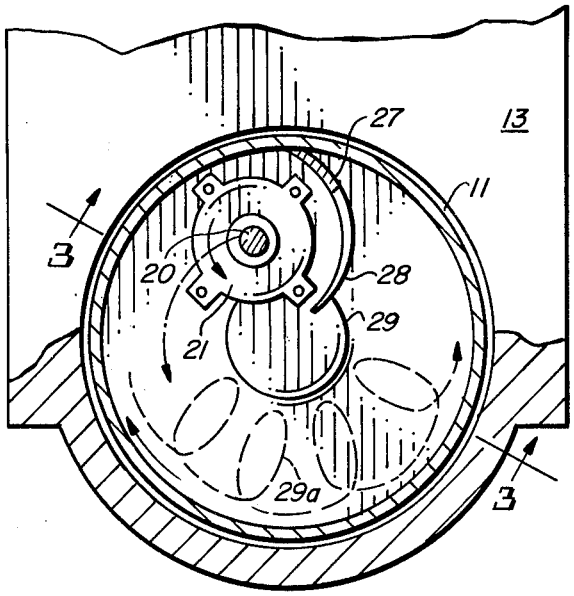
FIG. 2 is a horizontal sectional view taken substantially on the line 2—2 of FIG. 1.
Figure 3:
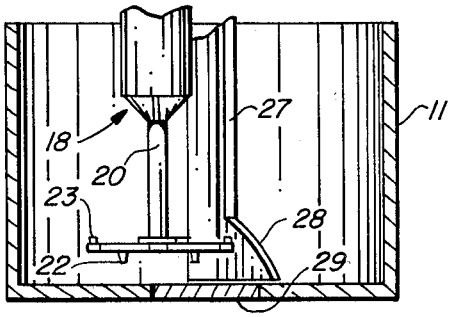
FIG. 3 is a fragmentary sectional view taken substantially on the line 3—3 of FIG. 2.
Figure 4:
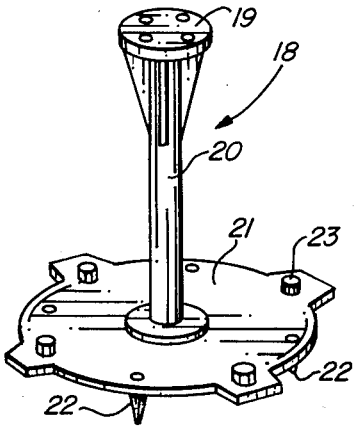
FIG. 4 and FIG. 5 are perspective views of rotors which can be employed in the mixing equipment shown in FIG. 1 and FIG. 2.
Figure 5:
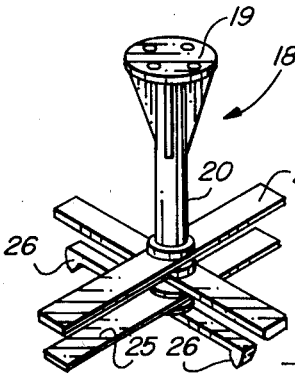

Although not shown, the mixing pan 11 is belt driven by a separate motor mounted adjacent to the mixing pan. The required horsepower of this motor is of course dependent on the size of the mixing pan employed and the characteristics of the batch of ingredients being processed. As previously mentioned, the mixing pan is rotatably mounted and in the particular embodiment illustrated in FIG. 2, rotates in a clockwise manner. Mounted to the top of mixer 10 and eccentrically within mixing pan 11 is rotor assembly 18. Although not shown, this assembly is normally provided with a separate variable speed motor so that the speed of the rotor assembly may be changed as desired. The rotor assembly consists of attachment member 19 for securing the assembly to the drive motor and shaft 20. Various types of mixing tools may be mounted on shaft 20 and FIG. 4 and FIG. 5 show two examples. The mixing tool of FIG. 4 consists of generally circular plate 21 to which are mounted pins 22. Weights 23 can be used to counterbalance the rotor assembly if this is required. In FIG. 5 the mixing tool consists of two pairs of arms or knives 25 which are mounted at substantially right angles to each other and can be provided with balance weights 26 to counterbalance the assembly if such is necessary. FIG. 2 and FIG. 3 show a rotor assembly as described in FIG. 4 and it will be noted that the assembly is eccentrically mounted within the mixing pan and rotates in a direction counter to the direction of rotation of the mixing pan.

Mounted within mixing pan 11 are means to insure that the materials within the mixing pan are subjected to the intensive countercurrent mixing operation. These means are secured to the top part of the mixing equipment immediately above the mixing pan and, as shown in FIG. 2 and FIG. 3 consist of a pan wall wiper 27 and pan bottom deflector 28 which is attached to the pan wall wiper. As the pan rotates in a clockwise direction, the pan wall wiper scrapes the reactant materials from the pan wall and directs such materials to the rotor area for improved mixing. In the same fashion, bottom deflector 28 gathers the reactant materials and directs them to the area of intensive mixing ensuring that all materials are subjected to the mixing process.

Figure 11:
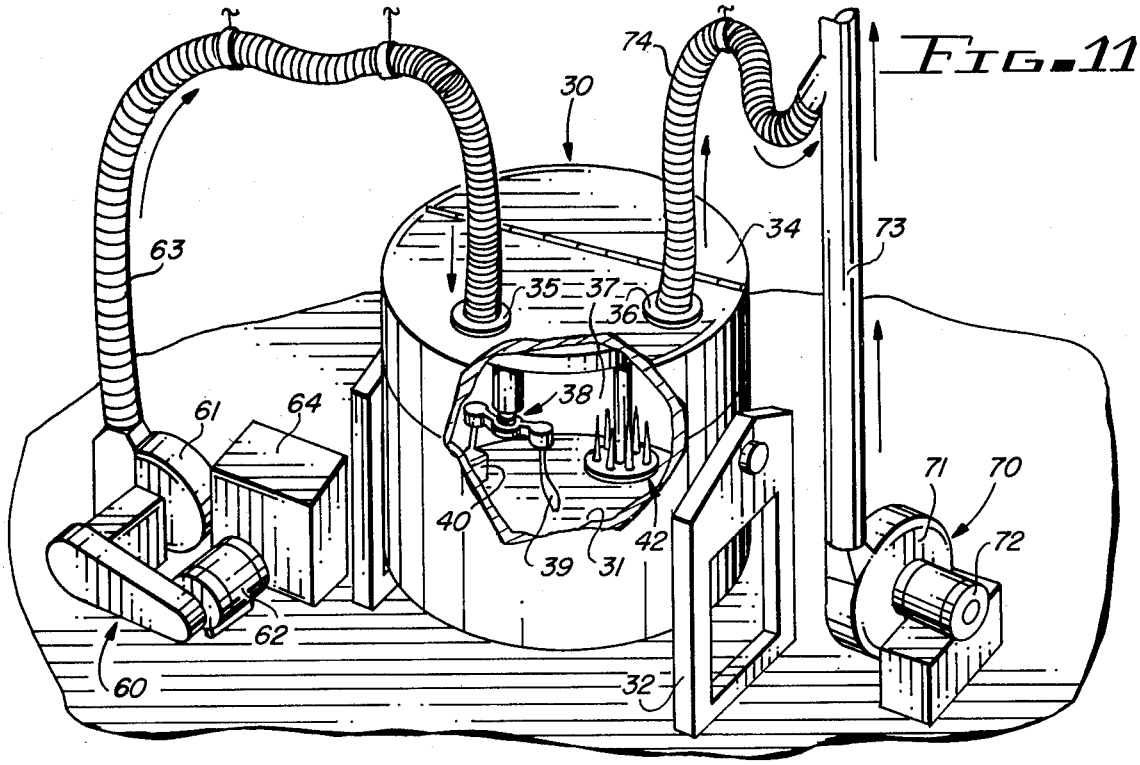
Figure 12:
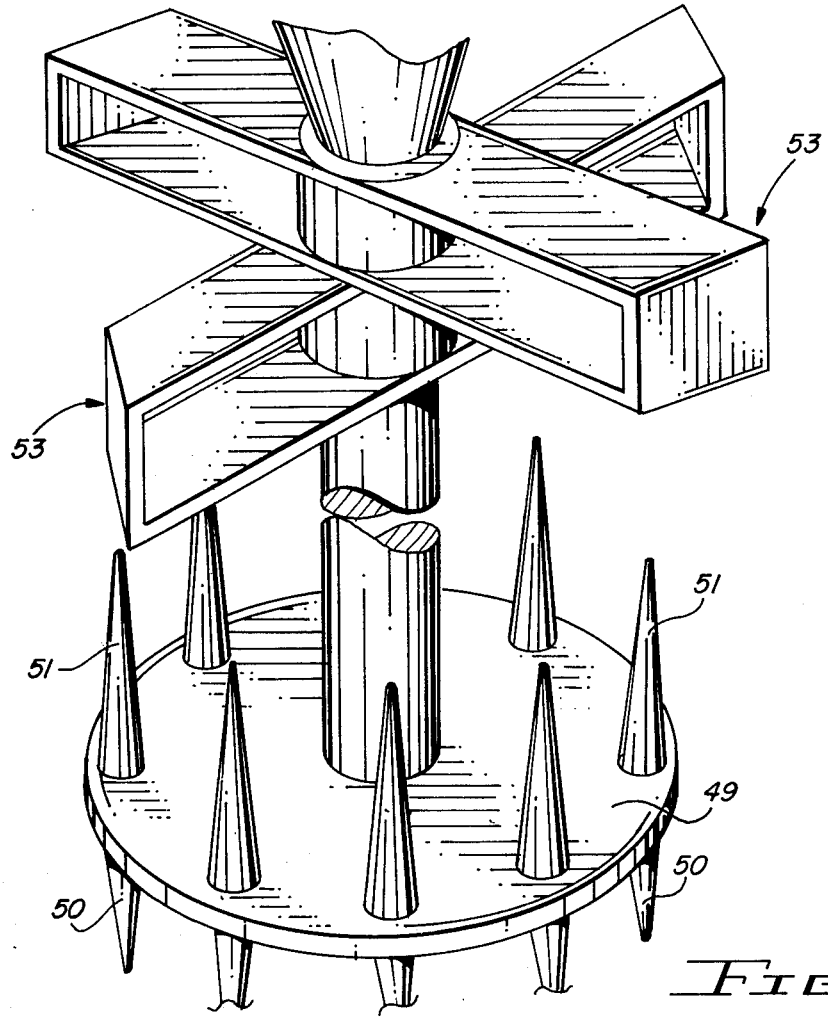

The mixing equipment depicted in FIG. 11 operates on the same principles as that of FIG. 1 but is designed to process much larger quantities of fatty acid sources and caustic. Whereas the equipment shown in FIGS. 1–3 will handle up to about 100 pounds per batch, the equipment of FIG. 11 will handle about 800 pounds. The mixer shown generally at 30 has a rotatably mounted mixing pan 31 mounted on frame 32. Access to the interior of the mixer is provided by hinged door 34. At the top are ports 35 and 36 which are used to introduce air under pressure to the mixing chamber 37 and, in the case of port 36 to serve as an exit for the pressurized air. Although not shown the mixer is provided with a watertight discharge gate at the bottom of the mixing pan to remove the soap granules. Within the interior of the mixer is an eccentrically mounted rotating mixing tool 38 which is shown in greater detail in FIG. 9 and FIG. 10. Mixing tool 38 is provided with a kneading bar 39 and mixing plow 40 and is powered by motor 40*a*. As shown most clearly in FIG. 9 the mixing tool 38 rotates in a direction 41*a* which is counter to the direction of rotation of pan which is shown by arrow 41. Thus as shown the pan rotates in a clockwise direction, mixing tool 38 rotates in a counter-clockwise direction. Also mounted within the mixer 30 is a high speed rotor assembly 42. This rotor is also designed to rapidly rotate in a direction counter to that of the pan. Various types of rotors may be used and FIG. 7 and FIG. 12 are two examples. The rotor of FIG. 7 consists of attachment member 43 for securing the rotor assembly to the upper portion of mixer 30, a drive motor (not shown) and shaft 44. Mounted at the end of shaft 44 is a circular plate 45 to which are mounted a series of pins 46 and 47. Pins 46 are somewhat shorter than pins 47. Pins 47 are also provided with a generally rectangular shaped cutting blade 48. It will be appreciated that a rotor assembly performs three functions in countercurrent mixing: that is, liquid mixing, dough chopping and granulation of the product. Another rotor assembly which is particularly well adapted to perform these functions is shown in FIG. 12. Attached to the underside of plate 49 is a series of rather short pins 50 which are mounted about the perimeter of plate 49. These pins are designed to help promote mixing of the reactants while they are still in a liquid phase. Mounted to the top side of plate 49 are a series of longer pins 51 which are designed to help promote granulation of the soap mass. Mounted near the top of shaft 52 are a pair of generally rectangular shaped open box-like choppers 53 which are designed to rip or chop the heavy dough-like soap mass. It is desirable that choppers 53 not contact the fluid reaction mass until it is semi-solid and non-sticky and therefore are mounted at a distance above the ends of pins 51.

Referring again to FIG. 11 the mixing equipment is also provided with an air blowing system consisting of an air pressure blower system shown generally at 60 and exhaust means shown generally at 70. The air pressure blower system includes blower 61 driven by motor 62 and duct 63. The system may also be provided with a cooling means 64, such as an evaporative cooler which serves to cool the air. Air is drawn through cooling means 64 and then forced into the interior of mixer 30 via duct 63. It is also possible to provide heating means in place of or in addition to the cooling means 64. A steam heated heat exchanger would be quite suitable.

The exhaust means 70 consists of suitable blower mounted in housing 71 powered by motor 72. A vertical pipe 73 is mounted to one end of the blower housing. Exhaust duct 74 is connected between the interior of mixer 30 and the upper end of pipe 73.

OPERATION

Referring to the equipment shown in FIGS. 1–3 the required amount of caustic can be introduced into the mixing equipment through the loading door 14. After the caustic is in the mixing pan 11 rotation of the pan is started and thereafter the fatty acid source is charged into the mixing pan either through the loading door 14 or preferably through port 15. Rotation of rotor assembly 18 is begun and the intensive countercurrent mixing of caustic and fatty acid takes place. The head on meeting of the rapidly moving stream of caustic and fatty acid source with the counter rotating assembly 18 creates a generally rotary movement of the reactants within the mixing pan appearing much like an eddy stream or whirlpool as shown by dotted arrow 29*a* of FIG. 2. As processing proceeds the reactants, which are initially in the liquid phase, gradually form a viscous, grainy appearing mass resembling mashed potatoes and it is at this stage that air may be introduced into the mixing pan through port 16 to enhance formation of soap granules. Continued mixing results in a more viscous dough-like mass which, upon continued mixing, starts to pull apart and shred into taffy-like strands and eventually breaks down into non-tacky granules.

While the mixing is underway additives normally employed in soap making such as brine solution, chelating agents, glycerine, and the like can be introduced into the mixing pan via port 15.

As previously noted the mixing equipment shown generally at 30 of FIG. 11 is able to handle much larger batches than the equipment of FIGS. 1–3. Although not shown, the mixer 30 is provided with suitable piping which permits introduction of the various soapmaking materials such as the triglycerides, fatty acids, caustic, and other additives directly into the interior of the mixer.

In practicing our process the fatty acid sources employed may be any of those which are customarily used in the making of soap. The limitation on the types of fatty acid sources employed is therefore dependent only on the particular qualities of the soap which are desired. Where fatty acids are readily available such acids ranging in chain length from 6 to 18 are usually employed.

Aqueous sodium hydroxide is commonly used to saponify the fatty acids or triglycerides, although aqueous potassium hydroxide can be used in the preparation of a so-called softer soap since the potassium soaps are more water soluble than the sodium soaps. It is also possible to use blends of the two alkalis in order to achieve special properties.

The amount of caustic employed in our process is that which is theoretically necessary to completely saponify the fatty acid source excepting in the production of so-called superfatted soap where the fatty acid source would be in excess. The caustic should be in liquid form and depending on the desired moisture content of the soap granules, will be at a concentration ranging from 10% to 70%, with the optimum being about 50%. It is possible to use 100% caustic when using ingredients which are high in moisture such as an alpha olefin sulfonate solution which normally contains about 70% by weight of moisture. The temperature of the caustic solution will normally range from about 120° F. to about 210° F. The amount of water present in the caustic and other additives customarily used in soap products will affect the amount of time required to reach the desired moisture level in the final soap granules. In addition, the saponification reaction itself produces some water as shown by the following:

Fatty Acid + Caustic Soda = Soap + Water $$R—COOH + NaOH = R—COONa + H_2O$$

Thus, according to the foregoing in theory approximately 6% by weight of water will be obtained in the reaction. This of course does not take into account water which is lost through the heat generated by the reaction, which we have found to usually be about 3% by weight of soap produced.

As with the caustic, the fatty acids and/or triglycerides are preferably liquid and at a temperature ranging from the melting point of the fatty acids or triglycerides to about 170° F. Although the reaction takes place somewhat more rapidly when these materials are at higher temperatures, because fatty acid sources at the lower temperatures give satisfactory results and are more easily handled, the optimum temperature range is from the melting point of such sources to about 140° F.

In reacting the fatty acid sources and caustic through the use of intensive countercurrent mixing, it is also possible and even desirable to incorporate into the mixture other ingredients that are customarily found in soap products, such as perfumes, colorants, emollients and the like. It is preferable that these additional materials be added to the mixing vessel after the saponification reaction has proceeded for a period of time.

In subjecting the fatty acid sources and caustic to intensive countercurrent mixing, we find that the introduction of air into the mixing vessel during saponification greatly enhances the formation of soap granules. The introduction of air not only minimizes processing time and energy requirements but, in addition, serves to reduce the moisture level and lower the temperatures of the reaction mixture which also helps to preserve heat sensitive ingredients. Although most fatty acids and triglycerides and caustic are basically not heat sensitive, other additives which may be included in the mixture, such as perfumes and oxidation inhibitors, are, and the blowing of air into the reaction vessel does serve to protect such ingredients. It is preferable to introduce the air when the saponification reaction is essentially complete. For a mixing pan having a capacity of about 100 pounds we find that air delivery of from 160 to about 250 SCFM works satisfactorily. With a mixing vessel having a capacity of about 800 pounds air delivery of from 1000 to 1200 SCFM worked satisfactorily. The air may be introduced directly into the mixing pan through port 16 as shown in FIG. 1 or port 35 of FIG. 11.

The order of addition of the principal reactants in our process does seem to affect the quality of the end product and can vary depending upon the batch size. Although acceptable soap granules are formed with virtually any order of addition, the preferred procedure with a mixing vessel as shown in FIGS. 1–3 is to charge the liquid caustic into the mixing vessel followed by a start up of the rotating pan. The fatty acids are then charged into the vessel over about a 2 minute period and thereafter the rotor is started. After the intensive countercurrent mixing has proceeded for a period of time, the free caustic level of the soap can be adjusted by adding either additional caustic or fatty acids. When it has been determined that neutralization is essentially completed, air is introduced to cool the mixture and to help remove moisture. The moisture level can be determined by appropriate measuring instruments. The intensive countercurrent mixing can be continued until the soap becomes a powder and has a moisture content of from 3–8%.

A preferred order of addition when using a vessel having a capacity of about 100 pounds is:

a. Charge caustic solution into vessel.
b. Begin rotation of pan.
c. Charge fatty acid and/or triglyceride into vessel.
d. Start rotor assembly.
e. Add brine solution with other additives such as chelating agents, glycerine, silicates and the like.
f. Continue mixing until saponification is essentially complete
g. Begin blowing of air into vessel while continuing the intensive countercurrent mixing.
h. Continue drying and mixing until granules form and the desired moisture level is reached.
i. Add soap slurry and perfume; these are ingredients normally added to the amalgamator in a conventional soap making process.
j. Discharge when slurry and perfume are completely mixed—usually about 1 minute.

FIGS. 4 and 5 shows different types of mixing tools which may be employed in the mixing equipment described herein and as shown in FIG. 1 and FIG. 2. There is no significant difference in the mixing abilities of these tools, although the mixing patterns are somewhat different. The star rotor shown in FIG. 5 splashed the mixture somewhat which was not a problem when the pin mixing tool of FIG. 4 was used. Therefore the pin-style mixing tool is preferred.

When using a larger mixing vessel such as is shown in FIG. 11 which has a capacity of about 800 pounds, the most preferred procedure is to initially introduce at least a portion of the fatty acid source and then begin to introduce the caustic. Thus a preferred order of addition when utilizing the mixing vessel shown in FIG. 11 is as follows:

a. Begin feed of fatty acid source
b. Begin feed of caustic when about $\frac{1}{3}$ of the fatty acid source is in the vessel
c. Start rotation of pan, mixing tool and high speed rotor
d. Begin addition of any additives when about $\frac{1}{2}$ of the caustic is in the vessel
e. Continue mixing until saponification is essentially complete f. Begin addition of air while continuing the intensive countercurrent mixing.
g. Remove granules when desired moisture level is obtained.

In Examples I through IX which demonstrate the versatility of our process all the processing was conducted in a Model R-7 Eirich Mixer manufactured by Maschinenfabrik Gustav Eirich of Nordbaden, West Germany. This mixer has a capacity of about 2⅓ cubic feet, with a batch size of about 100 pounds. We find that pan speeds of 10–50 rpm, preferably about 25 rpm, and rotor speeds of from 100 to 2400 rpm, preferably about 500–1000 rpm, are sufficient to provide low moisture soap granules. With this size mixing equipment, an air flow of up to about 250 SCFM gave the desired results.

EXAMPLE I

A sodium stearate soap was made using the following:

| | |
|---|---|
| Stearic Acid | 70.0 lbs. |
| NaOH (50% solution) | 20.9 lbs. |
| Additives (glycerine, chelating agent, preservative) | 3.3 lbs. |
| Brine (6% solids) solution | 3.2 lbs. |

The sodium stearate soap was prepared according to the following steps:

1. The caustic was added to the mixer pan.
2. Rotation of the mixer pan was begun at 48 rpm.
3. The fatty acid was charged into the mixing pan through port 15 over a period of two minutes.
4. The rotor assembly was turned on at 700 rpm.
5. The brine and additives were charged into the mixing pan.
6. The speed of the rotor was increased to 1400 rpm.
7. Mixing was continued for a period of approximately ten minutes.
8. Air was introduced into the mixing pan while continuing the intensive countercurrent mixing at 200 cfm for a period of 20 minutes.
9. The sodium stearate soap granules were removed from the mixing pan. Analysis indicated a moisture content of approximately 12 percent.

EXAMPLE II

A superfatted soap base was prepared from the following ingredients:

| | |
|---|---|
| Tallow/Coco Fatty Acids, 70:30 ratio | 70.0 lbs. |
| Sodium Hydroxide (50% solution) | 22.12 lbs. |
| Additives (glycerine, chelating agent, silicate) | 3.53 lbs. |
| Brine solution (6% Solids) | 3.36 lbs. |
| Coco Fatty Acid | 4.86 lbs. |

In preparing the superfatted soap base, the sodium hydroxide was introduced into the mixing pan and rotation of the pan was begun at 48 rpm. Thereafter the tallow/coco fatty acid blend was added to mixing pan through one of the ports over a period of 2 minutes followed by start-up of the rotor at a speed of 1400 rpm. After a period of 2 minutes the brine and additives were introduced into the mixing pan and the intensive countercurrent mixing was continued for a period of 2 minutes. After this the coco fatty acid was added to the mixture and air was introduced into the mixing pan at 200 cfm. for a period of 24 minutes. The soap base in granular form was removed and analysis showed that it had a moisture content of 11 percent.

EXAMPLE III

A 70:30 ratio tallow/coco soap base was prepared as follows:

| | |
|---|---|
| Tallow/Coco Fatty Acids, 70:30 ratio | 70.0 lbs. |
| Sodium Hydroxide (50% solution) | 22.5 lbs. |
| Additive (glycerine, chelating agent, silicate) | 3.9 lbs. |
| Brine (NaCl, 6% solids) | 3.4 lbs. |

The caustic was introduced into the mixing pan and rotation of the pan was begun at 48 rpm. The fatty acids were added over a period of 2 minutes via one of the ports and the rotor assembly was started at 1400 rpm. Thereafter the brine and additives were charged into the pan and the intensive countercurrent mixing continued for 20 minutes. Air was then introduced into the mixing pan at 180 cfm. and mixing was continued for an additional 15 minutes. Mixing was then discontinued and soap granules having a moisture content of about 12% and a diameter averaging about ¾ inch were obtained.

EXAMPLE IV

A perfumed soap base was prepared according to the following:

| | |
|---|---|
| Tallow/Coco Fatty Acids, 85:15 ratio | 70.0 lbs. |
| Sodium Hydroxide (50% solution) | 21.7 lbs. |
| Brine (NaCl - 6% solids) | 4.8 lbs. |
| Additives (Chelating agent, glycerin, silicate) | 1.7 lbs. |
| Slurry (colorants, antioxidants) | 2.3 lbs. |
| Perfume | 0.65 lbs. |

In preparing the soap, the sodium hydroxide was introduced into the mixing pan and rotation of the pan was begun at 48 rpm. Thereafter the tallow/coco fatty acid blend was added to mixing pan through one of the ports over a period of 2 minutes followed by start-up of the rotor at a speed of 1400 rpm. After a period of 2 minutes the brine and additives were introduced into the mixing pan and the intensive countercurrent mixing was continued for a period of 15 minutes. Air was then introduced into the pan while mixing continued at 180 cfm and for a period of 20 minutes. The air was shut off and thereafter the slurry and perfume was introduced in the pan followed by additional mixing for 1 minute. The soap granules were removed and analysis indicated a moisture content of 12%.

EXAMPLE V

A tallow/coco fatty acid soap was prepared from the following materials.

| | |
|---|---|
| Tallow/coco fatty acid (65:35) | 70 lbs. |
| Caustic (50% solution of NaOH) | 22.8 lbs. |
| Brine (6% solids) 4.48 lbs. | |
| Additive (glycerin, chelating agent and water) | 3.79 lbs. |

The foregoing were subjected to intensive countercurrent mixing according to following procedures.

| Time (minutes) | Rotor Speed (rpm) | Pan Speed (rpm) | Action/Observation |
|---|---|---|---|
| | — | | Added caustic* |
| | 48 | | Start pan rotation and Start addition of fatty acid** |
| 1½ | | | Complete addition of fatty acid |
| 1½ | 700 | | Start rotor |
| 2 | | | Add brine |
| 2¼ | | | Introduce additives |
| 4 | | | Phase change in mixture noted |
| 10 4½ | Stop | Stop | Stopped to scrape pan wall |
| 5¾ | 700 | | Start |
| 10¾ | Stop | Stop | Stop for soap sample |
| 11 | 1400 | 48 | Start |
| 15¾ | Stop | Stop | Stop for soap sample |
| 16 | 1400 | 48 | Start |
| 18¾ | Stop | Stop | Stop to scrape pan wall |
| 21 | 1400 | 48 | Start-air introduced, 200 cfm |
| 33 | | | Added 100 ml. fatty acid (pH adjustment) |
| 36 | | | Added 25 ml. 32% NaOH (pH adjustment) |
| 42 | Stop | Stop | Soap observed to be large "popcorn" size granules |
| 42¾ | 1400 | 48 | Start |
| 48 | Stop | Stop | Stop - remove soap granules |

*temp = 185° F.
**temp = 184° F.

The moisture content of the soap removed after 48 minutes of processing was 11% and the soap was at a temperature of 120° F.

EXAMPLE VI

A tallow/coco fatty acid soap was prepared from the following materials.

| | |
|---|---|
| Tallow/coco fatty acid (70:30) | 70 lbs. |
| Caustic (50% solution of NaOH) | 22.12 lbs. |
| Brine (7% solids) 3.36 lbs. | |
| Coco fatty acid | 4.86 lbs. |
| Additive (glycerin, chelating agent, water) | 3.53 lbs. |

The foregoing materials were subjected to intensive countercurrent mixing according to the following procedures.

| Time (minutes) | Rotor Speed (rpm) | Pan Speed (rpm) | Action/Observation |
|---|---|---|---|
| | | | Add caustic (168° F.) |
| | 700 | 48 | Add tallow/coco fatty acid (190° F.) |
| ¼ | | | Add brine |
| ½ | | | Introduce additive |
| 2 | | | Phase change; doughlike consistency |
| 3 | | | Stripped coco F.A. added; back to liquid state |
| 3½ | | | Introduce air at 200 cfm; phase change to dough like consistency |
| 7 | Stop | Stop | Scrape pan wall |
| 9 | 1400 | 48 | Start up again |
| 10 | Stop | Stop | Granulation beginning |
| 12 | 1400 | 48 | Start up again |
| 23 | | | Virtually all soap formed into granules |
| 24 | | | Reaction complete; granules range in size from ¾" to 1". Moisture = 11% |

EXAMPLE VII

Transparent soaps are usually made by a so-called semiboiled method followed by framing with substantial quantities of alcohol, glycerine or sugars included in the soap to promote a glossy, transparent condition. For example, commercial transparent bar soap is normally made by charging the fatty acid, triethanolamine, and sodium hydroxide into a kettle and boiling for several hours at 120° C. along with the addition of glycerine to inhibit growth of soap crystallites during subsequent framing and to promote transparency. After saponification is completed, the soap is poured into frames where the soap cools and solidifies. To achieve a desirable moisture level of about 10 to 12 percent the soap must be left in the frame for a period of up to 60 days.

To demonstrate the use of the intensive countercurrent mixing process in the preparation of a transparent soap base, the following ingredients were prepared:

| | | |
|---|---|---|
| Caustic Mixture: | | |
| | NaOH | 4.05 lbs. |
| | NaCl | 0.30 lbs. |
| | Water | 16.0 lbs. |
| Fatty Acid Mixture: | | |
| | Stearic | 13.0 lbs. |
| | Tallow | 25.0 lbs. |
| | $C_8/C_{10}$ | 2.6 lbs. |
| | Oleic | 1.0 lbs. |
| | Ricinoleic | 3.0 lbs. |
| Glycerine: | | 10.0 lbs. |
| Triethanolamine: | | 30.0 lbs. |

In processing, the caustic mixture was introduced into the mixing pan and rotation of the pan was begun at 48 rpm. Thereafter the fatty acid mixture was added through one of the ports and the rotor assembly was started at approximately 700 rpm. The triethanolamine and glycerine were added and the speed of the rotor was increased to 1400 rpm. Air was introduced into the mixing pan at about 200 cfm and the intensive mixing was continued for a period of about one hour. The resulting product was somewhat runny and plastic like, aerated and melted at 140° F. The batch was removed from the mixer and placed in a steam jacketed kettle and melted. Some foam formed on the surface of the liquid and was skimmed off. The liquid soap was then poured into trays and after a period of about 2 hours was hard enough to cut with a knife. The cut pieces of soap were slightly filmy but became virtually crystal clear when wet. Analysis of the soap gave the following results:

| | |
|---|---|
| Sodium Soap | 30.5 weight percent |
| TEA Soap | 25.9 weight percent |
| Free TEA | 22.1 percent |
| Water | 6.3 percent |
| pH | 8.4 |

After approximately two days exposure to air the bars became dry to the touch.

EXAMPLE VIII

The versatility of the intensive countercurrent process can be demonstrated in the preparation of a soap—alpha olefin sulfonate product. The following ingredients were placed into separate containers.

| | |
|---|---|
| Container A | |
| Alpha olefin sulfonate ($C_{14}$—$C_{18}$, 30% active) | 30 lbs. |
| Sodium lauryl sulfate | 0.72 lbs. |
| Silicate | 0.08 lbs. |
| Glycerin | 0.09 lbs. |
| Chelating agent | 0.03 lbs. |

-continued

| | |
|---|---|
| Container B | |
| Fatty alcohol (Adol 63) | 0.72 lbs. |
| Stearic acid | 1.59 lbs. |
| Paraffin (high MP) | 1.36 lbs. |
| Amide | 0.25 lbs. |
| Polyethylene glycol (PEG 6000) | 1.78 lbs. |
| Cocoamide | 0.25 lbs. |
| (All of the foregoing in B were heated to 150° F.) | |
| Container C | |
| Sodium hydroxide pellets | 6.68 lbs. |
| Container D | |
| Tallow/Coco fatty acid (85:15) | 0.95 lbs. |
| Coco fatty acid (hydrogenated) | 0.03 lbs. |
| (All of the foregoing in D were heated to 150° F.) | |

(All of the foregoing in D were heated to 150° F.)

In preparing the soap/synthetic product by intensive countercurrent mixing the following steps were followed.

1. The contents of container A were poured into the mixing pan and pan rotation begun at 48 rpm.
2. After approximately 30 seconds the NaOH pellets were added and mixing by rotation of the pan only was continued for about 1 minute.
3. Thereafter the fatty acids (Container D) were introduced and the rotor assembly started at 1090 rpm. Mixing was continued for about 10 minutes.
4. The contents of container B were then added and mixing was continued for a period of about 85 minutes.
5. Mixing was stopped and the product was observed to be non-tacky granules having a diameter of about 1". These granules were subsequently plodded, extruded and stamped into bars.

EXAMPLE IX

A series of experiments were run to determine the effect of blowing air into the mixing pan after saponification was essentially complete. In all these experiments the following formula was used.

| | |
|---|---|
| Tallow/Coco Fatty Acids 85/15 | 70 lbs. |
| NaOH (50%) | 21.91 lbs. |
| Additives | 2.28 lbs. |
| Brine (6% solids) | 2.13 lbs. |
| Slurry | 2.28 lbs. |
| Perfume | 0.65 lbs. |

Also, in each of the experiments the following procedure was followed:

(1) Charge caustic solution into mixing pan
(2) Start pan rotation, 48 rpm
(3) Charge fatty acid over a 2 minute period
(4) Start rotor assembly, 1090 rpm
(5) Add Additives and Brine
(6) Mix for 5 minutes
(7) Begin air blowing
(8) Add Slurry and Perfume
(9) Continue mixing for 15 minutes with a stopping of mixing every 2 minutes for samples.
(10) Discharge soap granules.

In evaluating the effect of air blowing, the soap was sampled every 2 minutes and temperature and moisture determinations were made. The following results were obtained:

| Air Blow Rate | Drying Rate | Cooling Rate |
|---|---|---|
| 200 cfm | .47% $H_2O$/min. | 3.3° F./min. |
| 160 cfm | .35% $H_2O$/min. | 1.6° F./min |
| 0 cfm | .16% $H_2O$/min. | 0 |

With no air blow the cooling rate of the saponification product is negligible and under these conditions a high temperature is maintained which may adversely affect heat sensitive ingredients such as perfume. It should also be noted that with air blow the drying rate of the saponification product was substantially increased which reduces processing time and energy requirements.

In the following Examples X, XI and XII processing was conducted in the larger Model DE-14 Eirich Mixer. This mixer, which is shown in FIG. 11, employs a horizontal rotating pan approximately 1400 mm in diameter and has a batch size of from about 600–900 pounds. As shown in FIG. 11 the mixer is provided with a rotating mixing tool 38 with kneading bar 39 and mixing plow 40. Mixing tool 38 is mounted eccentrically in the pan and rotates in a direction opposite to that of the rotation of pan 31 and during the tests was run at 52½ rpm. Also eccentrically mounted in pan 31 is high speed rotor 42 which also rotates in a direction opposite to that of the pan. The rotor speeds employed in the tests were 626 and 1253 rpm. The pan speed in all tests was 11½ rpm. The mixer was also equipped with an air blowing system consisting of a 7.5 hp blower 61 and a 15 hp exhaust blower 71 provided with a blast gate, not shown, designed to control the suction from the exhaust fan. Air flows of from 1000 to 1200 SCFM were employed. In addition a 5000 CFPM evaporative cooler was installed in the air stream to permit control of the temperature and humidity of the air being circulated in the mixer. In addition a steam heated radiator, not shown, was also installed in the air stream to permit heating of the air stream when desired.

EXAMPLE X

A series of runs was made using the following procedure, unless otherwise noted in the charts below.

1. Charge fatty acid; a 75:25 ratio of tallow to coco was used in all runs except number 1
2. Start pan and mixer (11½ and 52½ rpm respectively)
3. Start rotor (626 rpm)
4. Add 50% caustic solution feeding at about 25 lbs./minute
5. Start addition of glycerin solution, where used, when about one-half of caustic has been added
6. Charge remaining caustic at 35 lbs/minute
7. Mix for about 15 minutes at rotor speed of 626 rpm
8. Check alkalinity and adjust if necessary
9. Start drying by blowing air into reaction vessel
10. Discharge granules when at temperature of about 115° F.

The results of the tests are as follows.

| RUN NO. | | 1 | 2 | 3 | 4 | 5 |
|---|---|---|---|---|---|---|
| ITEM | UNITS | | | | | |
| Total Time | Minutes | 70 | 82 | 102¾ | 63 | 62½ |

-continued

| RUN NO. | | 1 | 2 | 3 | 4 | 5 |
|---|---|---|---|---|---|---|
| Alkali in Prod. | % | | Neutral | 0.018 | 0.07 | 0.03 |
| 75T/25C | lbs/°F. | | 485/133 | 488/135 | 480/152 | 481/134 |
| 85T/15C | lbs/°F. | 306.4/126 | | | | |
| Caustic | lb/°F. | 93.7/77 | 152/148 | 188/8/152 | 152/163 | 152.9/167 |
| 12% Brine | lbs/°F. | 15.4/ | 24.4/135 | 24.4/ | 24.4/135 | |
| Glycerine | lbs/°F. | | | 17.4/188 | 17.4/176 | 38.9/120 |
| Total | lbs. | 415.5 | 661.4 | 726.7 | 673.8 | 672.8 |
| Drum/Mixer | RPM | 11½/52½ | 11½/52½ | 11½/52½ | 11½/52½ | 11½/52½ |
| Rotor | RPM | 626/1253 | 626/1253 | 626/1253 | 626/1253 | 626 |
| In Fan | RPM | 2160 | 2600 | 2600 | 2600 | 2600 (977 SCFM) |
| Exhaust Fan | RPM | OFF | OFF | 3510 | 3510 | 3510 (1085 SCFM) |
| Cooler On/Off | | OFF | OFF | OFF | ON | ON |
| Air Heat On/Off | | OFF | OFF | On 67 min. | OFF | OFF |
| Order of Addition | | | | | | |
| 1 | | Caustic | Caustic & F.A. | F.A. | F.A. | F.A. |
| 2 | | F.A. | Brine | Caustic | Caustic | Caustic |
| 3 | | Brine | | Glycerin | Glycerin | Glycerin |
| 4 | | | | Brine | Brine | |
| Initial Charge | °F. | | | 150 | 137 | 120 |
| Maximum | °F. | 150 | 198.6 | 200+ | 190.5 | 200+ |
| Granule | type/°F. | /150 | Fine/129.9 | Med/137.9 | /116.5 | Med./120.6 |
| Comments | | | Homogeneous in 22 min. | 2 plows used. Some hard lumps of caustic soap | High % Caustic helped granulation | Glycerin added when ½ of caustic in. Homogeneous in 14 min. |

In analyzing the foregoing runs, it should be kept in mind that the processing of the reactants into granules involves three basic steps, that is: the mixing of the reactants to homogeneity, a drying step, and finally granulation. It should be noted in these series of runs that the reactant addition sequence is somewhat different from that shown in Examples I–IX. It was found that adding the caustic first to the mixing vessel caused the formation of some hard, high alkalinity particles which were difficult to break up and disperse in the subsequent mixing stages. In addition, adding both reactants together also formed some of these high alkalinity particles. It was found to be preferable to first introduce the fatty acid. In addition we found it is desirable to permit the reaction temperatures to reach 190°–200° F. and when the reaction heat did not reach at least about 190° F., some high alkalinity hard particles were formed. It was also observed that control of alkalinity is important. A high alkalinity, that is greater than about 0.1% of caustic, gave a more viscous neat soap which appeared much dryer than it actually was. When the mix was slightly on the acid side, fluidity was better and the time to homogeneity was reduced considerably.

With respect to the matter of the drying step, it was noted that the blowing of air through the reaction vessel was important in achieving reasonable processing times. An air velocity of 1000–1200 SCFM gave good results in lowering the batch temperature. It is possible that even greater air flow rates may be advisable with the limiting factor being the point where some reaction product could be carried over into the exhaust system. In the foregoing runs it was also observed that the air temperature had a direct affect on the granule moisture and this effect can be summarized as follows:

| Temperature of Incoming Air | Granule Moisture |
|---|---|
| 60–75° F. | 11–13.5% |
| 75–100° F. | 8–12% |

-continued

| Temperature of Incoming Air | Granule Moisture |
|---|---|
| Greater than 100° F. | 7–8% |

The general parameters that appear to have an affect on the moisture level of the granules and processing time are:

a. Starting formula moisture level. Increasing this moisture level increases granule moisture and also increases processing time.
b. The rate of air blow; that is, increasing the rate of air blow increases the rate of temperature loss resulting in granules having a higher moisture content and correspondingly results in shorter processing times.
c. As the temperature of the air being blown into the reaction vessel is lowered, a corresponding increase in the moisture content of the final appropriately sized granules and a decrease in the processing time was observed.
d. Reaction batch temperatures in the range of 190° F.–210° F. appear to give optimum results.

EXAMPLE XI

A further series of runs in the intensive mixing equipment described in Example X was conducted using the formula types as shown below.

| | Formula type | | | | |
|---|---|---|---|---|---|
| | A | B | C | D | E |
| Base Formula | % | % | % | % | % |
| 75/25 T/C Fatty Acid (222 A.V.) | 68.4 | 68.0 | 67.7 | 67.0 | 65.1 |
| NaOH (50%) | 21.8 | 21.7 | 21.6 | 21.4 | 20.7 |
| Additive (NaCl, preservatives, etc.)) | 9.8 | 9.8 | 9.7 | 9.6 | 9.3 |
| Extra $H_2O$ | 0 | 0.5 | 1.0 | 2.0 | 1.9 |

-continued

| | Formula type | | | | |
|---|---|---|---|---|---|
| | A | B | C | D | E |
| Slurry (Colorants, $H_2O$, $TiO_2$, Dispersants) | 0 | 0 | 0 | 0 | 1.1 |
| Perfume | 0 | 0 | 0 | 0 | 1.9 |
| | 100.0 | 100.0 | 100.0 | 100.0 | 100.0 |
| Theoretical: | | | | | |
| Total $H_2O$ % (after saponification | 23.1 | 23.5 | 23.9 | 24.6 | 24.6 |
| Total Charge (lbs.) | 815 | 819 | 823 | 831 | 857 |
| Total Product (theoretical with 12% $H_2O$) | 712 | 712 | 712 | 712 | 734 |

The purpose of these tests was to determine the effect of increasing the moisture content of the reactants somewhat, that is up to about 2% by weight; the effect of decreasing the feed temperatures of the reactants; and the effect of increasing reactant load in the mixing vessel. In conducting these tests the following procedure was followed:

1. Start feed of fatty acid
2. Start feed of caustic when about ⅓ of fatty acid had been introduced into mixer
3. Begin rotation of pan (11½ rpm) and rotor (626 rpm)
4. Begin introduction of additive when about one-half of caustic is in
5. Begin timing when all caustic is in mixer
6. At about 7 minutes open dampers and start pressure and exhaust blowers
7. Adjust alkalinity if required
8. Five minutes later again adjust alkalinity if required
9. Remove granules when following conditions occur:

| Formula Type | °F. |
|---|---|
| A | 116 |
| B | 115 |
| C | 114 |
| D | 113 |
| E | 112 |

The following results are typical for the various tests.

| RUN NO. | 1 | 2 | 3 | 4 | 5 |
|---|---|---|---|---|---|
| FORMULA TYPE | A | B | C | D | E |
| Batch Charge Lbs. | | | | | |
| 75/25 T/C/°F. | 558.5/122 | 554.5/128 | 557/122 | 555/122 | 556/128 |
| NaOH/°F. | 177.5/140 | 177/161 | 177/166 | 177.25/143 | 177/142 |
| Additive/°F. | 79.5/93 | 79.5/86 | 79.5/82 | 79.5/82 | 79.5/80 |
| Extra $H_2O$ lbs. | | 4 | 8 | 16 | 16 |
| Slurry | | | | | 9.5 |
| Perfume | | | | | 16.5 |
| Total lbs. | 815.5 | 815 | 821.5 | 827.75 | 854.5 |
| % $H_2O$ after Neutralization | 23.2 | 23.7 | 23.9 | 24.8 | 24.7 |
| Rotor RPM | 626 | 626 | 626 | 626 | 626 |
| Chilled Air | YES | YES | YES | YES | YES |
| Air in °F. | 81 | 77 | 74 | 75 | 77 |
| Peak Temperature | 212 | 206 | 199 | 198 | 200+ |
| Discharge Temperature | 115 | 115 | 115 | 114 | 112 |
| Total Time (Minutes) | 71 | 83 | 69 | 78 | 115 |
| Analysis of Granules % 1⅜" size | 69% | 78.6% | 81.24 | 80.24 | 78.1 |

It was observed that by increasing the moisture level of the batch charge a reduction in granule size was obtained. In addition, the granules were more uniform in size and concentrated in the ⅜" to 1" range. However, this additional moisture also generally increased processing time. These tests also showed that a decrease in the temperature of the reactants did not adversely affect granulation so long as the peak temperature of the reaction got up to about 190°–210° F. It was also learned that the fatty acid and caustic could be introduced almost simultaneously as long as sufficient fatty acid was added to make contact with the pins of the rotor and that the addition of caustic extended beyond the addition of the fatty acids.

EXAMPLE XII

Fats and Oils Saponification

Utilizing the equipment described in Example X soap granules were prepared from tallow and coconut oil. The tallow and coconut oil were heated to 150° F. and 510 lbs. of tallow and 90 lbs. of coconut oil were introduced simultaneously in the intensive mixer. A stoichiometric amount of 50% NaOH was then introduced into the mixer over a period of about 90 minutes. The pan speed was 11½ RPM, the mixing tool was run at 52½ RPM and the high speed rotor run at 626 RPM. After a total reaction time of 130 minutes saponification was 99.3% complete. An analysis of the soap granules indicated the following:

10.5% moisture
8.5% glycerine
Light brown color
¼" size granules (average)

EXAMPLE XIII

Figure 6:
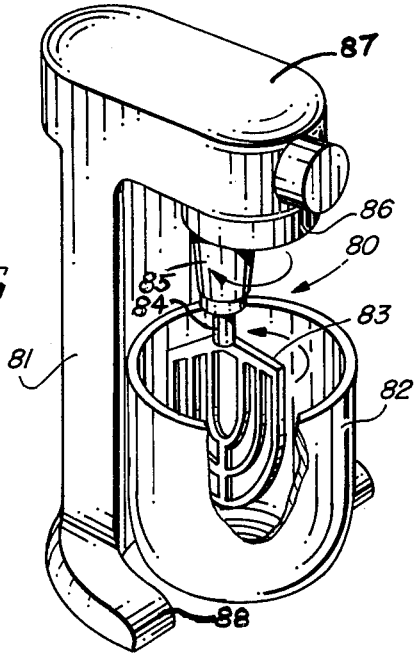
FIG. 6 is a perspective view of a portable mixer which can provide countercurrent mixing on highly reduced scale.

The mixer shown in FIG. 6 is a Hobart Model A200 mixer and is shown generally at 80. The mixer consists of housing 81 with a two speed motor (not shown) in the upper portion 87 of the housing. Mounted between legs 88 and the housing is a stationary bowl 82. A paddle-shaped mixing tool 83 with attendant shaft 84 is secured in chuck 85 which in turn is attached to gear housing 86. Mixer 80 is designed so that the mixing tool 83 rotates in a counter-clockwise direction while at the same time is following an orbital clockwise path around the interior of bowl 82. This sets up a counter-current mixing process. Thus the gear housing will rotate in a clockwise direction while the tool 83 rotates in a counter-clockwise direction.

Soap granules were prepared in the mixer using the following materials.

| | |
|---|---|
| Tallow/coco fatty acid (70:30) | 10 lbs. |
| Caustic (50% solution of NaOH) | 3.2 lbs. |
| Brine (6% solids) | 0.83 lbs. |

The fatty acid blend was charged into bowl 82 at a temperature of about 130° F. The brine and caustic solution were combined and added to the bowl at room temperature over a period of about 1 minute. The mixing tool 83 was set to rotate counter-clockwise at 115 rpm and its orbit was 47 rpm in a clockwise direction. In approximately 10 minutes the batch went from a thin milky liquid to a dough-like state. At this point ambient air was directed at the batch by means of a blower and mixing was continued. After about twenty minutes of further mixing granulation took place. The resulting product was randomly sized granules with average size about ½ inch. This demonstrates that the process of high intensity countercurrent mixing is very important in providing soap granules and also demonstrates that a wide variety of equipment may be employed in our process.

From the foregoing it is apparent that intensive countercurrent mixing as described herein provides a superior technique for rapidly producing a low moisture soap in granular form under ambient pressure conditions.

We claim:

1. A process for making soap granules from raw materials normally employed in soap manufacture including a fatty acid source and caustic comprising the steps of introducing said materials into an enclosed mixing vessel, causing said materials in said vessel to rotate in a generally circular path while simultaneously bringing said materials into contact with a rotating means mounted within said vessel, said means rapidly rotating in a direction counter to the initial direction of flow of said materials in said vessel whereby saponification takes place and soap granules are formed having a moisture content of less than about 20% by weight.

2. The process according to claim 1 wherein said materials also include a synthetic detergent.

3. The process according to claim 1 wherein air is blown into said vessel during saponification.

4. The process according to claim 1 wherein said fatty acid source are long chain monocarboxylic acids having a chain length of from 6 to 18 carbon atoms.

5. The process according to claim 1 wherein said counter rotating means are mounted eccentrically within said vessel and at a distance from the wall of said vessel.

6. The process according to claim 1 whereby the contact of said materials with the rapidly rotating means creates a series of whirlpools of said materials within said vessel.

7. The process according to claim 1 wherein said soap granules are removed from said vessel and thereafter subjected to plodding, extrusion and stamping to form soap bars.

8. The process according to claim 1 wherein said materials in said vessel are initially in a liquid phase and with continued mixing become a viscous dough-like mass, thereafter into strands and finally into granules.

9. A process for making soap in the form of granules from materials normally employed in soap manufacture including a fatty acid source and caustic comprising the steps of introducing said materials into an enclosed mixing vessel, causing said materials to be subjected to intensive countercurrent mixing for a period of time sufficient to form soap granules having a moisture content of less than about 20% by weight.

10. The process according to claim 1 wherein said fatty acid source and caustic are in liquid form.

11. The process according to claim 3 wherein said air is cooled to a temperature below ambient air prior to blowing it into said vessel.

12. A process for making transparent soap from a fatty acid source, caustic, triethanolamine and glycerine comprising the steps of: introducing said caustic into an enclosed mixing vessel provided with a pan and a rotating means mounted within said pan and said vessel, each of said pan and said rotating means being rotatable in a direction counter to each other, starting the rotation of said pan, introducing said fatty acid source into said pan and starting the rotation of said rotating means to provide countercurrent mixing, introducing triethanolamine and glycerine into said pan and continuing said countercurrent mixing until saponification is complete, heating the resulting soap until liquid and thereafter pouring said liquid soap into a suitable mold.

13. The process of claim 2 wherein said synthetic detergent is an alpha olefin sulfonate.

14. A process for making transparent soap from materials normally employed in the manufacture of said soaps including a fatty acid source, caustic, triethanolamine and glycerin comprising the steps of introducing said materials into an enclosed mixing vessel, causing said materials to be subjected to intensive counter-current mixing for a period of time sufficient to complete saponification, heating the resulting soap until liquid and thereafter pouring said liquid into a suitable mold.

15. The process of claim 14 wherein air is blown into said vessel during saponification.

16. A process for making soap in granular form from raw materials normally employed in soap manufacture including a fatty acid source, and caustic comprising the steps of introducing said fatty acid source into an enclosed mixing vessel provided with a pan and a rotating means mounted within said pan and said vessel, each of said pan and said means being rotatable in a direction counter to each other, introducing said caustic into said pan when at least a portion of said fatty acid source is in said pan, starting the rotation of said pan and said means, beginning the blowing of air into said pan after saponification is essentially complete and continuing the rotation of said pan and means until soap graules having a moisture content of less than about 20% by weight are obtained.

17. The process of claim 1 wherein the resulting product is in powder form and has a moisture content of less than 10% by weight.

18. The process of claim 14 wherein said materials are selected from the group consisting of a fatty acid source, caustic, glycerine, alcohols, sugars, alkalis and mixtures thereof.

* * * * *